US011939860B2

(12) United States Patent
Seren et al.

(10) Patent No.: US 11,939,860 B2
(45) Date of Patent: Mar. 26, 2024

(54) ORIENTING A DOWNHOLE TOOL IN A WELLBORE

(71) Applicant: Saudi Arabian Oil Company, Dhahran (SA)

(72) Inventors: Huseyin Rahmi Seren, Houston, TX (US); Max Deffenbaugh, Fulshear, TX (US); Mohamed Larbi Zeghlache, Al Khubar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 137 days.

(21) Appl. No.: 17/164,067

(22) Filed: Feb. 1, 2021

(65) Prior Publication Data

US 2022/0243583 A1 Aug. 4, 2022

(51) Int. Cl.

| | |
|---|---|
| ***E21B 47/092*** | (2012.01) |
| ***E21B 23/00*** | (2006.01) |
| ***E21B 47/12*** | (2012.01) |
| ***E21B 47/26*** | (2012.01) |

(52) U.S. Cl.

CPC ..... *E21B 47/092* (2020.05); *E21B 23/00* (2013.01); *E21B 47/138* (2020.05); *E21B 47/26* (2020.05)

(58) Field of Classification Search

CPC .... E21B 47/092; E21B 47/138; E21B 47/024; E21B 47/12; E21B 47/26; E21B 47/09; E21B 47/07; E21B 47/04; E21B 47/10; E21B 47/13; E21B 23/00; E21B 23/10; G01C 21/00; G01C 21/10

See application file for complete search history.

(56) References Cited

U.S. PATENT DOCUMENTS

| | | | |
|---|---|---|---|
| 2,558,427 | A | 6/1951 | Fagan |
| 4,808,925 | A | 2/1989 | Baird |
| 5,720,345 | A | 2/1998 | Price et al. |
| 6,084,403 | A | 7/2000 | Sinclair et al. |
| 6,411,084 | B1 | 6/2002 | Yoo |
| 7,363,967 | B2 | 4/2008 | Burris, II et al. |

(Continued)

FOREIGN PATENT DOCUMENTS

| | | |
|---|---|---|
| CA | 2858051 | 11/2016 |
| EP | 2954151 | 12/2015 |

(Continued)

OTHER PUBLICATIONS

U.S. Appl. No. 17/234,555, filed Apr. 19, 2021, Seren et al.

(Continued)

*Primary Examiner* — George S Gray

(74) *Attorney, Agent, or Firm* — Osha Bergman Watanabe & Burton LLP

(57) ABSTRACT

A downhole tool includes a body configured to move in a wellbore formed from a terranean surface to a subterranean formation in a direction downhole of the terranean surface independent of a downhole conveyance attached to the body; one or more sensors positioned in the body, the one or more sensors configured to measure a value associated with at least one of the wellbore or the terranean surface; and at least one mass positioned in the body and configured to adjust an orientation of the body in response to one or more forces acting on the body as the downhole tool moves in the wellbore in the direction downhole of the terranean surface.

37 Claims, 10 Drawing Sheets

(56) References Cited

U.S. PATENT DOCUMENTS

| | | | | |
|---|---|---|---|---|
| 8,074,713 | B2 | 12/2011 | Ramos et al. | |
| 9,587,477 | B2 | 3/2017 | Lafferty et al. | |
| 9,650,851 | B2 | 5/2017 | Whitsitt et al. | |
| 10,316,645 | B2 | 6/2019 | Ingraham et al. | |
| 2002/0096322 | A1* | 7/2002 | Barrett | E21B 44/005 166/250.01 |
| 2005/0241825 | A1* | 11/2005 | Burris, II | E21B 43/119 166/120 |
| 2007/0277970 | A1* | 12/2007 | Botnmark | B08B 9/0436 166/173 |
| 2015/0275649 | A1 | 10/2015 | Orban et al. | |
| 2016/0069163 | A1* | 3/2016 | Tolman | E21B 43/119 166/381 |
| 2020/0400013 | A1* | 12/2020 | McBride | G01P 3/66 |
| 2022/0010648 | A1 | 1/2022 | Musso et al. | |

FOREIGN PATENT DOCUMENTS

| | | | | |
|---|---|---|---|---|
| WO | 2016176643 | | 11/2016 | |
| WO | WO-2016176643 | A1 * | 11/2016 | E21B 23/10 |
| WO | 2020117231 | | 6/2020 | |
| WO | WO-2020117231 | A1 * | 6/2020 | E21B 21/08 |
| WO | 2020220087 | | 11/2020 | |
| WO | WO-2020220087 | A1 * | 11/2020 | E21B 47/00 |
| WO | 2020257742 | | 12/2020 | |
| WO | WO-2020257742 | A1 * | 12/2020 | E21B 34/14 |
| WO | 2022011388 | | 1/2022 | |

OTHER PUBLICATIONS

Bar-Kochba et al., "A Fast Iterative Digital Volume Correlation Technique for Large Deformation Measurements," Experimental Mechanics, 55:, Feb. 2014, 261-274, 14 pages.

Buljac et al., "Digital volume correlation: review of progress and challenges," Experimental Mechanics, 58:5, 2018, 661-708, 127 pages.

Estrada et al., "Intuitive Interface for the Quantitative Evaluation of Speckle Patterns for Use in Digital Image and Volume Correlation Techniques," J. Applied Mechanics, 82:9 (095001), Sep. 2015, 5 pages.

Commons.wikimedia.org [online], "File:6DOF.svg" Feb. 2015, [retrieved on Apr. 7, 2021], retrieved from: URL <https://commons.wikimedia.org/w/index.php?curid=38429678>, 4 pages.

Hunting-intl.com [online], "Mechanical Centralizers and Decentralizers" Mar. 2015, [retrieved on Apr. 7, 2021], retrieved from: URL <http://www.hunting-intl.com/titan/wireline-hardware-and- accessories/mechanical-centralizers-and-decentralizers>, 1 page.

Wikipedia.org [online], "Metacentric Height" Nov. 2003, [retrieved on Apr. 7, 2021], retrieved from: URL <https://en.wikipedia.org/wiki/Metacentric_height>, 7 pages.

PCT International Search Report and Written Opinion in International Appln. No. PCT/US2022/014664, dated Apr. 25, 2022, 15 pages.

* cited by examiner

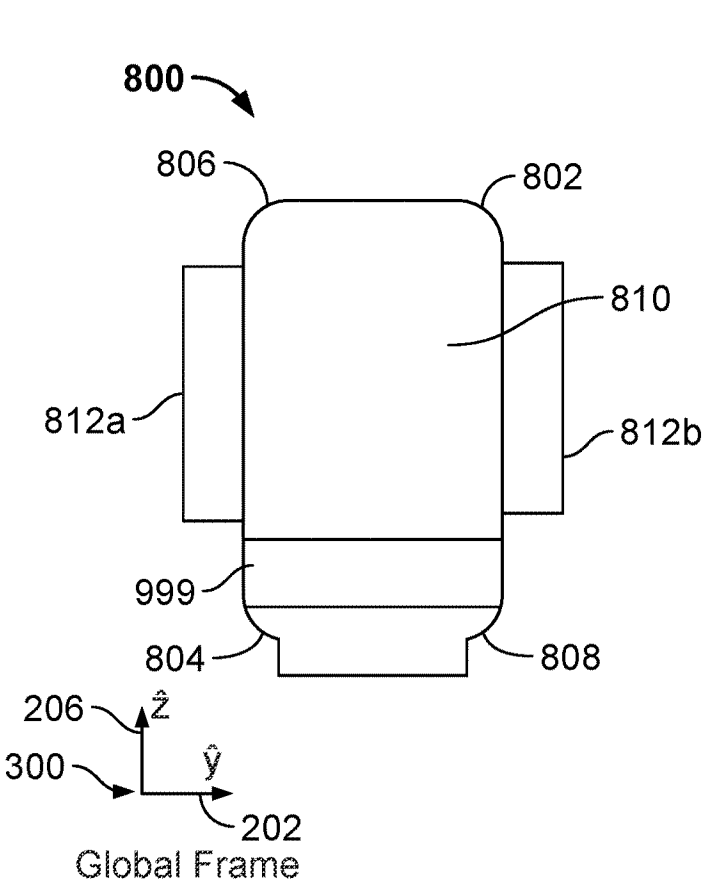
FIG. 8B
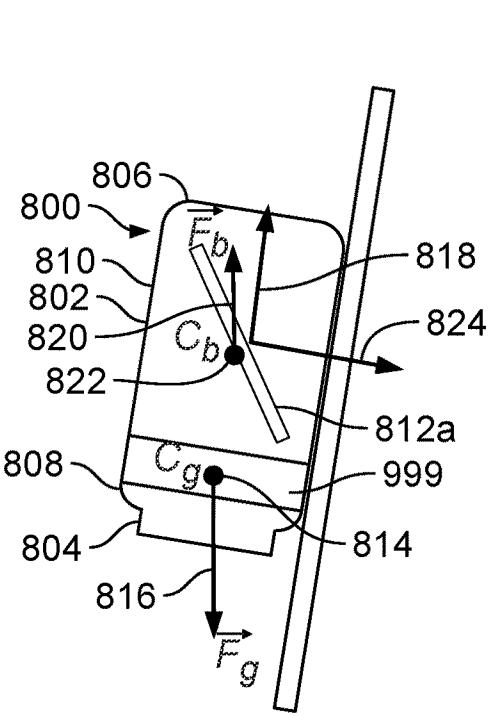
FIG. 8A
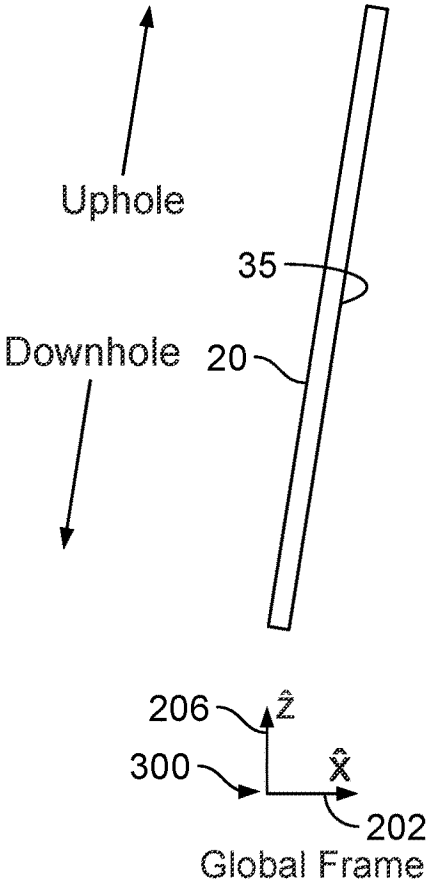

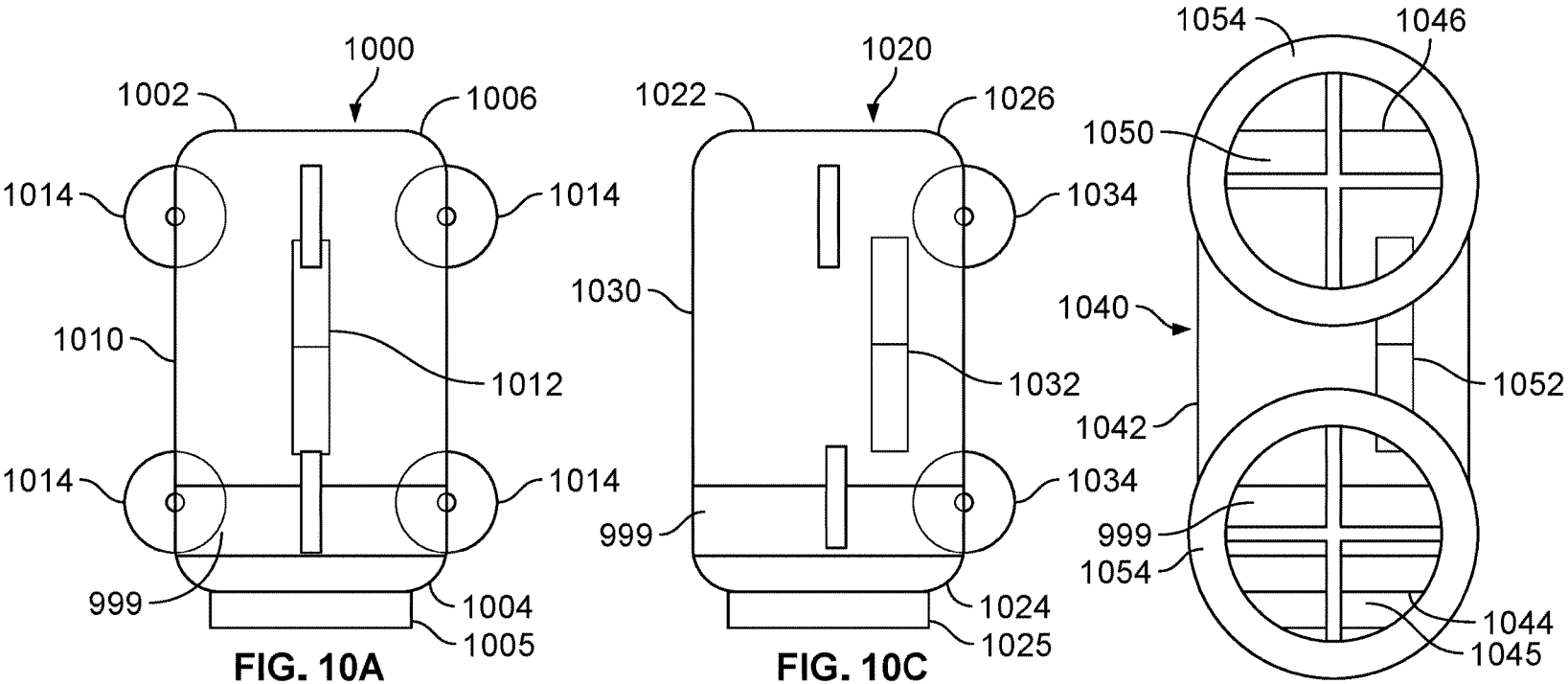
FIG. 10A
FIG. 10C
FIG. 10E
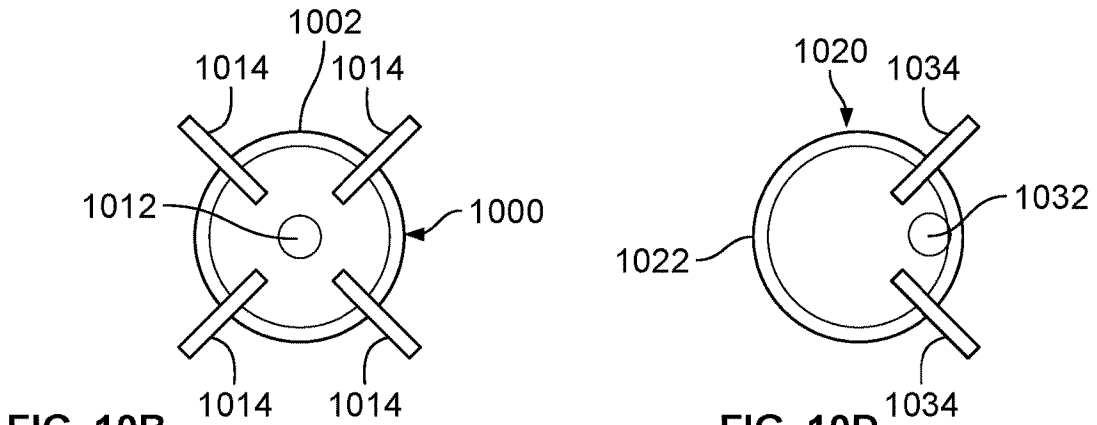
FIG. 10B
FIG. 10D
FIG. 10F

ORIENTING A DOWNHOLE TOOL IN A WELLBORE

TECHNICAL FIELD

The present disclosure describes apparatus, systems, and methods for orienting a downhole tool in a wellbore.

BACKGROUND

Downhole wellbore tools that are fixed to a downhole conveyance from the surface (for example, by a coiled tubing, wireline, or other conveyance) are conventionally run into and out of the wellbore to perform operations. Each downhole tool has some freedom to move in three-dimensional space within the wellbore even attached to the downhole conveyance. In some examples, however, wireline downhole tools have a high aspect ratio that limits their ability to yaw and pitch within the three-dimensional space. Such tools may remain within the wellbore during their travel which also limits their positional freedom in one or more planes. Conventionally, centralizers or decentralizers can be used to further constrain these freedoms of wireline tools. Even though the friction and adhesive forces can be high under these conditions, the weight of a wireline tool pulling it downhole and amount of tension that can be applied through a steel wire to pull it up help wireline tools to move.

SUMMARY

In an example implementation, a downhole tool includes a body configured to move in a wellbore formed from a terranean surface to a subterranean formation in a direction downhole of the terranean surface independent of a downhole conveyance attached to the body; one or more sensors positioned in the body, the one or more sensors configured to measure a value associated with at least one of the wellbore or the terranean surface; and at least one mass positioned in the body and configured to adjust an orientation of the body in response to one or more forces acting on the body as the downhole tool moves in the wellbore in the direction downhole of the terranean surface.

In an aspect combinable with the general implementation, the at least one mass includes a buoyant portion positioned within, or attached to, a first location of the body; and a ballast portion positioned within, or attached to, a second location of the body.

In another aspect combinable with any of the previous aspects, the first location is at or near an uphole end of the body, and the second location is at or near a downhole end of the body.

In another aspect combinable with any of the previous aspects, the buoyant portion includes a first buoyant portion attached to an exterior surface of the body at a first exterior location and a second buoyant portion attached to the exterior surface of the body at a second exterior location radially opposite the first exterior location.

In another aspect combinable with any of the previous aspects, the at least one mass further includes at least one magnet positioned within, or attached to, a third location of the body.

In another aspect combinable with any of the previous aspects, the at least one mass includes at least one magnet positioned within, or attached to, a location of the body.

In another aspect combinable with any of the previous aspects, the at least one magnet is positioned within the body to align, with a magnetization force, the body with a casing, the at least one magnet including a casing collar locator.

In another aspect combinable with any of the previous aspects, the at least one magnet includes an electro-permanent magnet.

In another aspect combinable with any of the previous aspects, the electro-permanent magnet includes a casing collar detector.

In another aspect combinable with any of the previous aspects, the body includes a cap portion located at an uphole end of the body and a nose portion located at a downhole end of the body.

In another aspect combinable with any of the previous aspects, the cap portion includes a sharp cap, a rounded cap, a flat cap, or a conic cap.

In another aspect combinable with any of the previous aspects, the nose portion includes a sharp nose, a rounded nose, or a conic cap.

In another aspect combinable with any of the previous aspects, the nose portion further includes at least one wheel or roller mounted to a downhole end of the nose portion.

Another aspect combinable with any of the previous aspects further includes one or more wheels coupled to an exterior surface of the body.

In another aspect combinable with any of the previous aspects, the one or more forces includes a buoyant force and a gravitational force.

In another aspect combinable with any of the previous aspects, the one or more sensors includes at least one of a casing collar detector or a corrosion detector.

In another example implementation, a method for running an untethered downhole tool in a wellbore includes inserting the untethered downhole tool into the wellbore at a terranean surface, the untethered downhole tool including a body, one or more sensors positioned in the body, and at least one mass positioned in the body; running the untethered downhole tool within the wellbore in a direction downhole of the terranean surface and toward a subterranean formation independent of a downhole conveyance attached to the body; and adjusting, with the at least one mass positioned in the body, an orientation of the body in response to one or more forces acting on the body as the downhole tool runs in the wellbore in the direction downhole of the terranean surface.

In an aspect combinable with the general implementation, adjusting, with the at least one mass positioned in the body, the orientation of the body relative to the one or more forces acting on the body includes: adjusting the orientation of the body relative to the one or more forces acting on the body with a buoyant portion of the at least one mass that is positioned within, or attached to, a first location of the body; and adjusting the orientation of the body relative to the one or more forces acting on the body with a ballast portion of the at least one mass that is positioned within, or attached to, a second location of the body.

In another aspect combinable with any of the previous aspects, the first location is at or near an uphole end of the body, and the second location is at or near a downhole end of the body.

In another aspect combinable with any of the previous aspects, adjusting the orientation of the body relative to the one or more forces acting on the body with a buoyant portion of the at least one mass that is positioned within, or attached to, a first location of the body includes adjusting the orientation of the body relative to the one or more forces acting on the body with a first buoyant portion attached to an exterior surface of the body at a first exterior location; and adjusting the orientation of the body relative to the one or more forces acting on the body with a second buoyant portion attached to the exterior surface of the body at a second exterior location radially opposite the first exterior location.

In another aspect combinable with any of the previous aspects, adjusting, with the at least one mass positioned in the body, the orientation of the body relative to the one or more forces acting on the body includes adjusting, with at least one magnet positioned within, or attached to, a third location of the body, the orientation of the body relative to the one or more forces acting on the body by generating a magnetic force with the at least one magnet relative to a casing positioned in the wellbore.

In another aspect combinable with any of the previous aspects, adjusting, with the at least one mass positioned in the body, the orientation of the body relative to the one or more forces acting on the body includes adjusting, with at least one magnet positioned within, or attached to, a location of the body, the orientation of the body relative to the one or more forces acting on the body by generating a magnetic force with the at least one magnet relative to a casing positioned in the wellbore.

In another aspect combinable with any of the previous aspects, the at least one magnet includes at least one electro-permanent magnet.

Another aspect combinable with any of the previous aspects further includes adjusting the generated magnetic force by changing a magnetization of the at least one electro-permanent magnet; and based on the adjusted magnetic force, changing a position of the body relative to the casing.

Another aspect combinable with any of the previous aspects further includes detecting one or more casing collars with the at least one electro-permanent magnet during the running the untethered downhole tool within the wellbore.

Another aspect combinable with any of the previous aspects further includes adjusting one or more hydrodynamic forces that acts on the body as the untethered downhole tool runs in the wellbore in the direction downhole of the terranean surface with at least one of a cap portion located at an uphole end of the body or a nose portion located at a downhole end of the body.

In another aspect combinable with any of the previous aspects, the cap portion includes a sharp cap, a rounded cap, a flat cap, or a conic cap.

In another aspect combinable with any of the previous aspects, the nose portion includes a sharp nose, a rounded nose, or a conic cap.

Another aspect combinable with any of the previous aspects further includes contacting, with at least one wheel or roller mounted to a downhole end of the nose portion, the wellbore or a casing installed in the wellbore as the untethered downhole tool runs in the wellbore in the direction downhole of the terranean surface.

Another aspect combinable with any of the previous aspects further includes contacting, with one of more wheels coupled to an exterior surface of the body, the wellbore or a casing installed in the wellbore as the downhole tool runs in the wellbore in the direction downhole of the terranean surface.

In another aspect combinable with any of the previous aspects, the one or more forces includes a buoyant force and a gravitational force.

Another aspect combinable with any of the previous aspects further includes measuring a value associated with at least one of the wellbore or the terranean surface with the one or more sensors as the untethered downhole tool runs in the wellbore in the direction downhole of the terranean surface.

In another example implementation, a downhole tool system includes an untethered downhole tool that includes a housing and a sensor package mounted in the housing, the housing including a downhole end and an uphole end; and means for orienting the untethered downhole tool with respect to a radial alignment angle and one or more vertical alignment angles in response to one or more forces acting on the untethered downhole tool as the untethered downhole tool runs in a wellbore in a direction downhole of a terranean surface, the means for orienting the untethered downhole tool mounted within or attached to the housing.

In an aspect combinable with the general implementation, the means for orienting the untethered downhole tool includes a first mass having a first density positioned at or near the downhole end and a second mass having a second density less than the first density positioned at or near the uphole end.

In another aspect combinable with any of the previous aspects, the means for orienting the untethered downhole tool includes one or more magnets positioned in or attached to the housing.

In another aspect combinable with any of the previous aspects, the second mass includes an uphole cap mounted on the uphole end.

In another aspect combinable with any of the previous aspects, the first mass includes a downhole cap mounted on the downhole end.

In another aspect combinable with any of the previous aspects, the means for orienting the untethered downhole tool includes one or more magnets positioned in or attached to the housing.

In another aspect combinable with any of the previous aspects, the means for orienting the untethered downhole tool includes one or more wheels mounted to the housing.

In another aspect combinable with any of the previous aspects, the sensor package includes an inertial sensor that includes a casing collar locator.

Implementations of an untethered downhole tool according to the present disclosure may include one or more of the following features. For example, an untethered downhole tool according to the present disclosure can be adjusted into a favorable orientation with respect to, for example, a casing installed in a wellbore to enable measurements related to the casing (for example, casing collar location). As another example, an untethered downhole tool according to the present disclosure can be adjusted in orientation absent of a conventional centralizer or decentralizer, which can possibly jam the tool especially when there is a transition between different size casings. As another example, an untethered downhole tool according to the present disclosure can be adjusted in orientation to offset a center of gravity for low side self-positioning. As further examples, an untethered downhole tool according to the present disclosure can, as compared to conventional wireline tools, lower drag forces, maximize effective fluid contact area, and increase sensor signal amplitude by strategically orienting the tool along a low-side of the tool. As a further example, an untethered downhole tool according to the present disclosure can resist rotational force due to fluid heterogeneity as well as provide a corrective moment in a vertical axis. As a further example, an untethered downhole tool according to the present disclosure can be optimally oriented without creating higher fluid friction forces. As another example, an untethered downhole tool according to the present disclosure can pass through restrictions and complex profiles (for example, a nipple, a seal assembly, a cross-over) that conventional wirelines tools cannot.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

FIGS. 8A-8B are schematic diagrams of another example implementation of an untethered downhole tool that includes one of more mass components to adjust an orientation of the tool in three-dimensional space in a wellbore according to the present disclosure.

FIGS. 10A-10F are schematic diagrams of other example implementations of an untethered downhole tool that includes one or more mass components to adjust an orientation of the tool in three-dimensional space in a wellbore according to the present disclosure.

DETAILED DESCRIPTION

Figure 1:
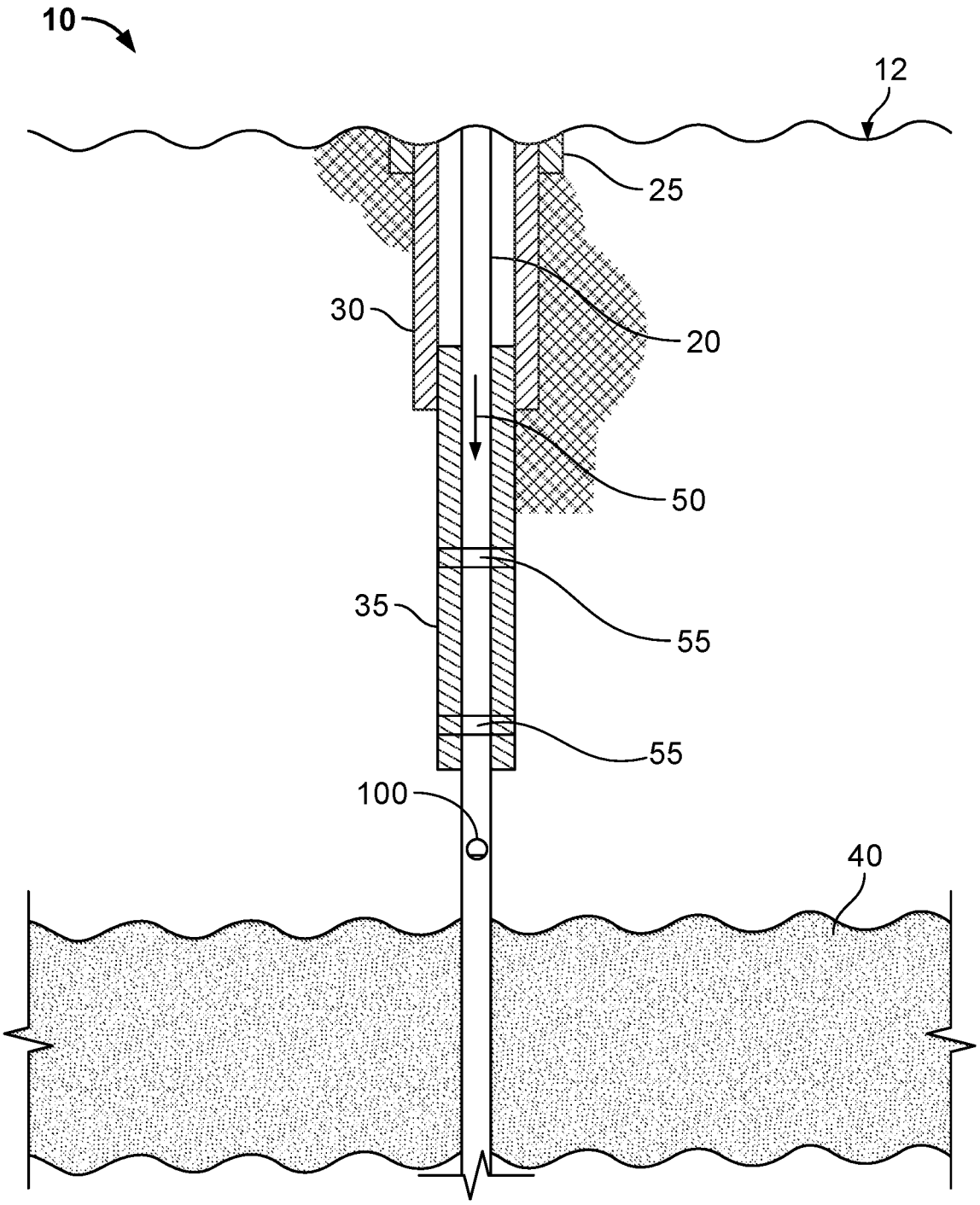
FIG. 1 is a schematic diagram of wellbore system that includes an untethered downhole tool according to the present disclosure.

FIG. 1 is a schematic diagram of wellbore system 10 that includes an untethered downhole tool 100 according to the present disclosure. Generally, FIG. 1 illustrates a portion of one embodiment of a wellbore system 10 according to the present disclosure in which the downhole tool 100, as an untethered downhole tool 100, may be run into a wellbore 20 and activated during the run in (or run out) process or when the tool 100 reaches a particular location of a wellbore tubular 17 (or simply, tubular 17) within the wellbore 20. In this example, the downhole tool 100 is untethered in that, during the running in process, the running out process, or during any operations of the downhole tool 100 in the wellbore 20, the downhole tool 100 is disconnected, decoupled, or otherwise unattached from a downhole conveyance, such as a tubular (tubular work string or coiled tubing) or wireline or other conductor. In some aspects, the untethered downhole tool 100 may be conveyed into the wellbore 20, or out of the wellbore 20 by, for instance, a fluid circulated within the wellbore tubular 17 or within the wellbore 20, either alone or in combination with other forces on the untethered downhole tool 100 (for example, gravitational forces, buoyant forces, hydrodynamic forces, or a combination thereof).

In some aspects, the untethered downhole tool 100 comprises a relatively lightweight miniaturized tool (for example, a tool with a length several times smaller than the wellbore diameter). For such tools, there are not many limiting factors for the alignment within a wellbore; thus all the degrees of freedoms are available. Conventional centralizers and decentralizers that are used for wireline tools may not be suitable for such miniaturized untethered tools since they increase the chance of jamming in the wellbore.

In some aspects, the untethered downhole tool 100 can serve various purposes, such as collecting physical or chemical information regarding the downhole fluids or the formation rocks of the wellbore system 10. Such collection of information may be enhanced by adjusting an orientation of the untethered downhole tool 100 in three-dimensional space within the wellbore 20. As an example, for any measurement that involves one or more casings installed in the wellbore system (for example, of casing collars or otherwise), an orientation of a sensor package within the untethered downhole tool 100 with respect to the casing can affect the collection of information. Conventionally, a wireline downhole tool (in other words, a downhole tool attached to a downhole conveyance) with a casing collar locator is either centralized or decentralized to fix a sensor position relative to the casing. However, the untethered downhole tool that, for instance, includes no active steering, can have varying orientations in the wellbore 20 depending on, for example, its hydrodynamics and composition, geometry of the wellbore 20, and fluids inside the wellbore 20 (or wellbore tubular 17). This varying of orientation can complicate any measurements, for example, that involves the casing such as casing collar location.

As described in more detail herein, in some aspects, the untethered downhole tool 100 includes one or more mass components, such as one or more components that adjust a density, center of gravity, center of mass, or hydrodynamics (or a combination thereof) that adjust an orientation of the untethered downhole tool 100 in the wellbore 20. In some aspects, the one or more mass components may adjust the orientation of the untethered downhole tool 100 during the running in process, during the running out process, while the tool 100 is stationary (or substantially stationary) within the wellbore 20, or a combination thereof.

As shown, the wellbore system 10 accesses a subterranean formation 40 and provides access to hydrocarbons located in such subterranean formation 40. In an example implementation of system 10, the system 10 may be used for a production operation in which the hydrocarbons may be produced from the subterranean formation 40 within the wellbore tubular 17 (for example, as a production tubing or casing). However, tubular 17 may represent any tubular member positioned in the wellbore 20 such as, for example, coiled tubing, any type of casing, a liner or lining, another downhole tool connected to a work string (in other words, multiple tubulars threaded together), or other form of tubular member.

A drilling assembly (not shown) may be used to form the wellbore 20 extending from the terranean surface 12 and through one or more geological formations in the Earth. One or more subterranean formations, such as subterranean zone 40, are located under the terranean surface 12. As will be explained in more detail below, one or more wellbore casings, such as a surface casing 30 and intermediate casing 35, may be installed in at least a portion of the wellbore 20. In some embodiments, a drilling assembly used to form the wellbore 20 may be deployed on a body of water rather than the terranean surface 12. For instance, in some embodiments, the terranean surface 12 may be an ocean, gulf, sea, or any other body of water under which hydrocarbon-bearing formations may be found. In short, reference to the terranean surface 12 includes both land and water surfaces and contemplates forming and developing one or more wellbore systems 10 from either or both locations.

In some embodiments of the wellbore system 10, the wellbore 20 may be cased with one of more casings. As illustrated, the wellbore 20 includes a conductor casing 25, which extends from the terranean surface 12 shortly into the Earth. A portion of the wellbore 20 enclosed by the conductor casing 25 may be a large diameter borehole. Additionally, in some embodiments, the wellbore 20 may be offset from vertical (for example, a slant wellbore). Even further, in some embodiments, the wellbore 20 may be a stepped wellbore, such that a portion is drilled vertically downward and then curved to a substantially horizontal wellbore portion. Additional substantially vertical and horizontal wellbore portions may be added according to, for example, the type of terranean surface 12, the depth of one or more target subterranean formations, the depth of one or more productive subterranean formations, or other criteria.

Downhole of the conductor casing 25 may be the surface casing 30. The surface casing 30 may enclose a slightly smaller borehole and protect the wellbore 20 from intrusion of, for example, freshwater aquifers located near the terranean surface 12. The wellbore 20 may than extend vertically downward. This portion of the wellbore 20 may be enclosed by the intermediate casing 35. Any of the illustrated casings, as well as other casings that may be present in the wellbore system 10, may include one or more casing collars 55 (as shown in FIG. 1).

As shown, the untethered downhole tool 100 may be run into the wellbore 20 and through the tubular 17. In some aspects, as shown, the untethered downhole tool 100 may be inserted into the wellbore 20, which may be filled with a fluid, such as a drilling fluid or otherwise. In such aspects, the untethered downhole tool 100 may be oriented and weighted (as discussed in more detail later) to move downhole from the terranean surface 12 and toward the subterranean formation 40 through the wellbore fluid.

In some aspects, the wellbore fluid is not static in the wellbore 20 but is a circulated (for example, pumped) wellbore fluid 50 that dynamically moves the untethered downhole tool 100 through the wellbore 20. Thus, in some aspects, the untethered downhole tool 100 is moved through the wellbore 20 in a fluid (either static or dynamic) without being connected to any other form of downhole conveyance, such as a working string of downhole conductor (for example, wireline or slickline or other conductor).

Figure 2:
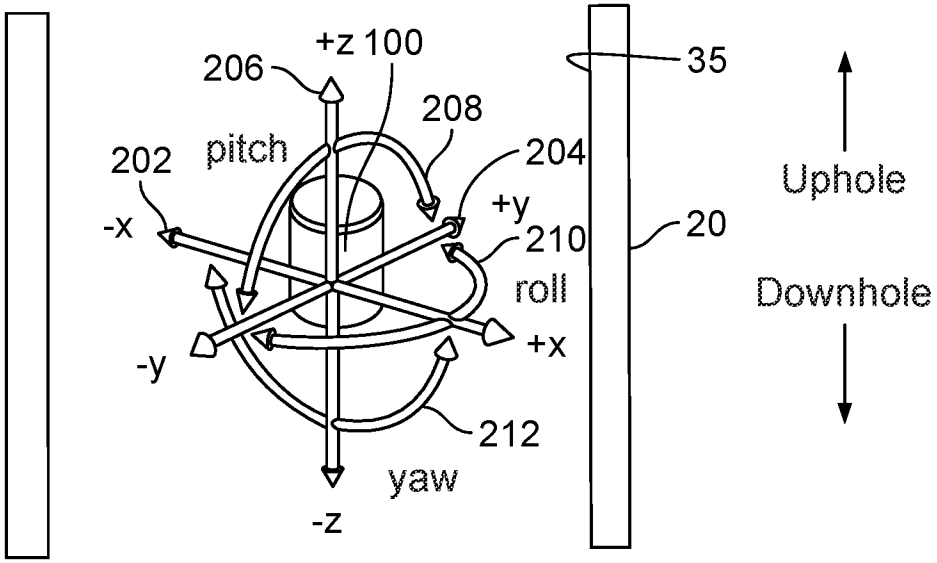
FIG. 2 is a schematic diagram of an untethered downhole tool in three-dimensional space in a wellbore according to the present disclosure.

Rotation or other movement of the untethered downhole tool 100 in three-dimensions within the wellbore 20 may adjust or change an orientation of the untethered downhole tool 100. For example, FIG. 2 is a schematic diagram of the untethered downhole tool 100 in three-dimensional space in the wellbore 20. As shown, there are six degrees of freedom of the untethered downhole tool 100 in a three-dimensional space within the wellbore 20. These displacements occur linearly along three orthogonal axes and rotationally about them as shown in FIG. 2. The three axes are the x axis 202, the y-axis 204, and the z-axis 206. As shown in this example, the z-axis 206 represents an axis aligned with an axis of a vertical portion of the wellbore 20. The rotational freedom of the untethered downhole tool 100 includes a pitch 208 about the x-axis 202, a yaw 212 about the y-axis 204, and a roll 210 about the z-axis 206.

Conventional wireline tools can have a high aspect ratio that largely limits their ability to yaw and pitch. Such conventional tools remain within a wellbore during travel, which also limits their positional freedom in an x-y-plane (where z is along the axis of the wellbore). Moreover, centralizers or decentralizers can be used to further constrain these freedoms. In addition, a weight of a wireline tool pulling it downhole and amount of tension that can be applied through a steel wire to pull it uphole help wireline tools to move under these conditions. However, even wireline tools can be stuck in some cases.

An untethered downhole tool, in contrast, may include no such active steering and may mainly displace in the z direction thanks to forces such as gravity, buoyancy, or flow pressure. However, there can be little to no control over an untethered downhole tool its remaining five degrees of freedom if an axial dimension of such a tool is shorter than the well diameter. Thus, the methods used by wireline tools to maintain orientation within the wellbore can be difficult to apply for untethered tools, which can be shorter than a diameter of the wellbore itself.

Figure 3B:
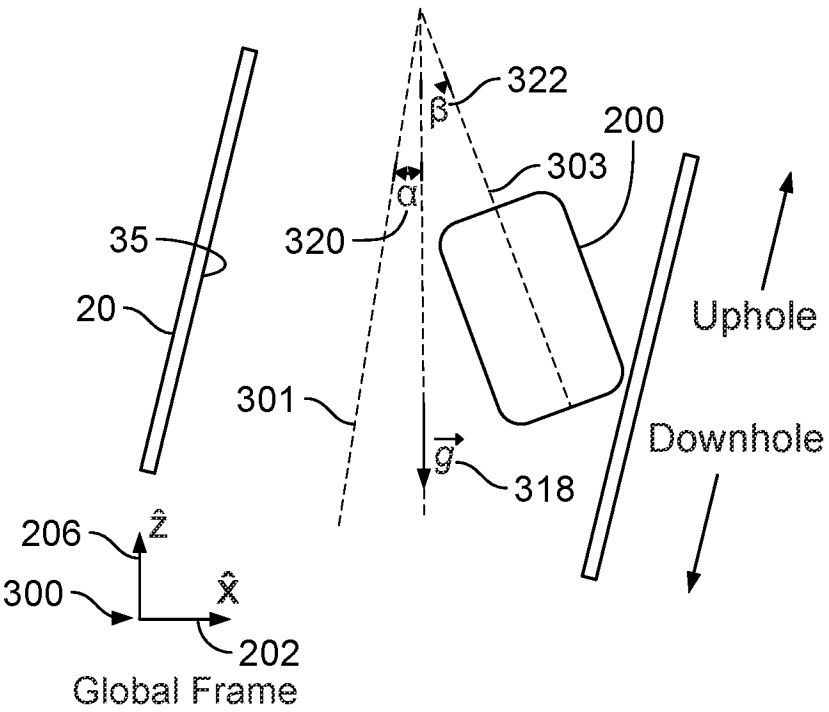
FIGS. 3A-3B are schematic diagrams of an angular orientation of an untethered downhole tool in three-dimensional space in a wellbore according to the present disclosure.
Figure 3A:
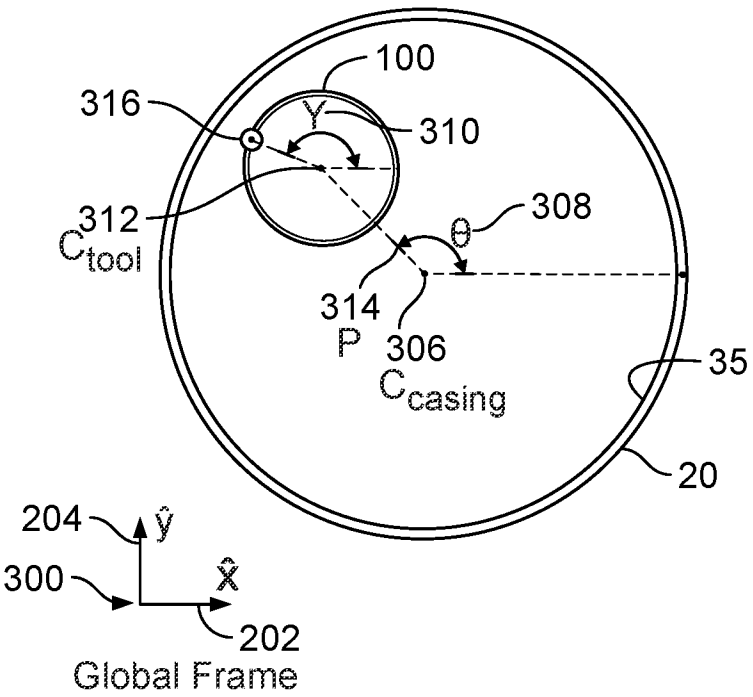

Indeed, due to cylindrical geometry of a wellbore, displacements in the x-y plane can be replaced by a radial measurement in a global frame 300 (with x-axis 202, y-axis 204, and z-axis 206). For example, FIGS. 3A-3B are schematic diagrams of an angular orientation of the untethered downhole tool 100 in three-dimensional space in the wellbore 20 according to a radial notation. As shown, displacements in the x-y plane can be replaced by a radial displacement ($\rho$) 314 of the untethered downhole tool's geometric center ($C_{tool}$) 312 from the center of the wellbore 20 (or center of casing 35) ($C_{casing}$) 306 and an angle, $\theta$, 308 from the x-axis 202 as shown in FIG. 3A.

The untethered downhole tool 100 may have a circular symmetry (in cross-section as shown in FIG. 3A) or may not have circular symmetry or it may have a specific sensor 316 at or near an exterior surface of the tool 100 that makes roll angle, $\gamma$, 310 a concern. As shown in FIG. 3B, vertical alignment angles relative to the z-axis 206 are shown and correspond to pitch angle and yaw angle. An angle between a central axis 301 of the casing 35 and a central axis 303 of the untethered downhole tool 100 is represented as a summation of two angles that are defined with respect to the gravitational vector 318 (in other words, gravity) (or z-axis 206). Well deviation angle, $\alpha$, 320 is not a degree of freedom, however it can be important to define an orientation of the wellbore 20 with respect to gravity 318 since it can affect an alignment of the untethered downhole tool 100 (for example, during free fall). The untethered downhole tool's angle 322 with the gravitational vector 318 is represented as $\beta$. The sixth degree of freedom is a vertical angle into the figure (in other words, the pitch 208 about the x-axis 202), but not shown in FIG. 4. In the present disclosure, pitch angle constraints and alignment methods will be the same as the yaw angle; therefore they are not addressed separately.

Figure 4:
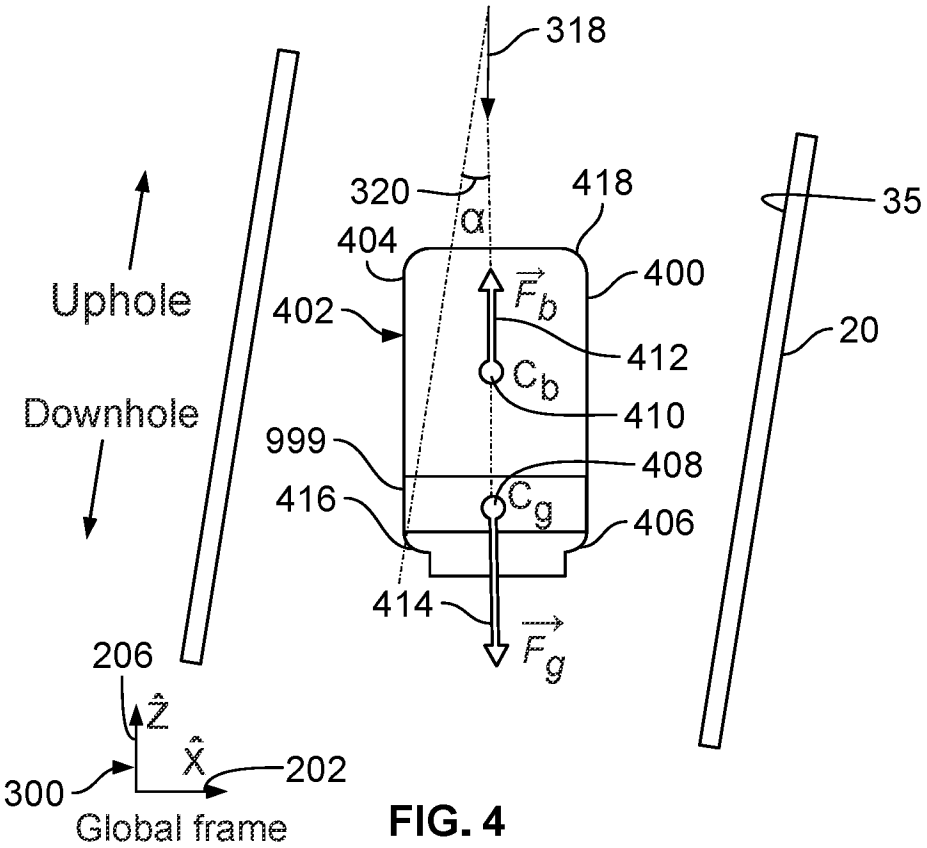
FIG. 4 is a schematic diagram of an example implementation of an untethered downhole tool that includes one or more mass components to adjust an orientation of the tool in three-dimensional space in a wellbore according to the present disclosure.

FIG. 4 is a schematic diagram of an example implementation of an untethered downhole tool 400 that includes one of more mass components to adjust an orientation of the tool 400 in three-dimensional space in the wellbore 20. In some aspects, untethered downhole tool 400 can be used as or be the untethered downhole tool 100 shown in the wellbore system 10 shown in FIG. 1. FIG. 4 further shows one or more forces acting on the untethered downhole tool 400. As shown in this example implementation, the untethered downhole tool 400 includes a housing 402 that has a downhole end 416 and an uphole end 418. The housing 402, in this example, includes a volume that can enclose all or a portion of a sensor package 999. The sensor package 999 can include, for instance, a casing collar locator or other sensors (such as an inertial sensor) configured to determine one or more measurements or characteristics of the casing 35, or other wellbore tubulars. The sensor package 999, in some aspects, may determine or measure one or more values associated with a fluid in the wellbore 20 or a subterranean formation adjacent the wellbore 20.

In this example, the one or more mass components include a ballast 406 positioned on or in the housing 402 at or near the downhole end 416 and a buoyant member 404 positioned on or in the housing 402 at or near the uphole end 418. In some aspects, the ballast 406 may be a weight or member that is of a higher density or overall mass as compared to the buoyant member 404. In some aspects, the buoyant member 404 can be an empty or fluid-filled portion of the housing 402. In some aspects, the buoyant member 404 can have a lower density or weight relative to the ballast 406. In some aspects, the untethered downhole tool 400 may include only the ballast 406 or only the buoyant member 404, for example, depending on a desired orientation of the untethered downhole tool 400 within the wellbore 20.

In some aspects, one or both of the ballast 406 or buoyant member 404 can adjust an orientation of the untethered downhole tool 400 in the wellbore, either alone or in combination. For example, the ballast 406 and/or buoyant member 404 may create a separation of a center of gravity ($C_g$) 408 (from which a gravitational force 414 originates) of the untethered downhole tool 400 and a center of buoyancy ($C_b$) 410 (from which a buoyant force 412 originates) of the untethered downhole tool 400. This separation can create a corrective (for example, righting) moment that rotates the housing 402 of the untethered downhole tool 400 to a stable position and minimizes its potential energy. For example, to create a separation between the two centers 408 and 410, a variation in density along an axis of the untethered downhole tool 400 is created by, for example, placement of the ballast 406 and/or the buoyant member 404. For instance, by grouping higher density components such as the sensor package 999 and the ballast 406 at the downhole end 416 and placing low density components such as the buoyant member 404 (for example, made of syntactic foam) at the uphole end 418, the righting moment can align yaw and pitch of the untethered downhole tool 400. In some aspects, this alignment occurs with respect to the direction of gravity 318 (in other words, angle $\beta$ is 0° or approximately 0°) and a degree of the alignment with the casing 35 may depend on the well deviation angle 320 ($\alpha$).

Figure 5A:
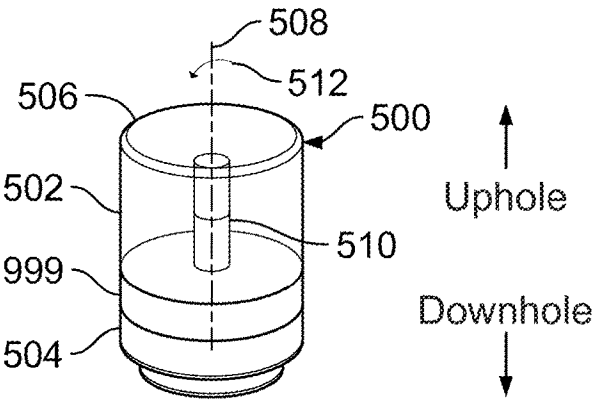
FIGS. 5A-5B are schematic diagrams of another example implementation of an untethered downhole tool that includes one of more mass components to adjust an orientation of the tool in three-dimensional space in a wellbore according to the present disclosure.
Figure 5B:
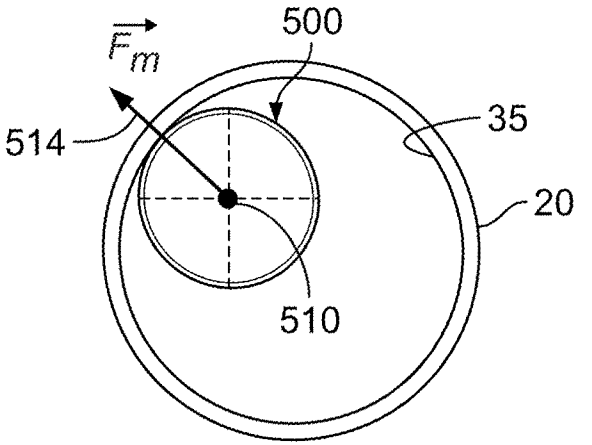

FIGS. 5A-5B are schematic diagrams of an example implementation of an untethered downhole tool 500 that includes one or more mass components to adjust an orientation of the tool in three-dimensional space in the wellbore 20. In some aspects, untethered downhole tool 500 can be used as or be the untethered downhole tool 100 shown in the wellbore system 10 shown in FIG. 1. FIGS. 5A-5B further show one or more forces acting on the untethered downhole tool 500. As shown in this example implementation, the untethered downhole tool 500 includes a housing 502 that has a downhole end 504 and an uphole end 506. The housing 502, in this example, includes a volume that can enclose all or a portion of the sensor package 999. The sensor package 999, as described, can include, for instance, a casing collar locator or other sensors configured to determine one or more measurements or characteristics of the casing 35, or other wellbore tubulars. The sensor package 999, in some aspects, may determine or measure one or more values associated with a fluid in the wellbore 20 or a subterranean formation adjacent the wellbore 20.

In this example, the one or more mass components include a magnet 510 positioned on or in the housing 502. In this example, the magnet 510 is positioned with its axial centerline aligned with an axial centerline of the untethered downhole tool 500. In some aspects, the magnet 510 can be permanent, electro-permanent, or an electromagnet. According to the present disclosure, an electro-permanent magnet is a permanent magnet with a coil wrapped around it. A magnetization state can be changed by applying a current through the coil. Depending on the magnet type and dimensions, number of turns on the coil, and the amplitude of the current, the change in the magnetization can be temporary or permanent. Electro-permanent magnets can also have benefits over the other two such that it can be turned off unlike a permanent magnet. An electro-permanent magnet can create a magnetic pull force with a smaller foot-print compared to an electromagnet and requires power only to change the magnetic polarization, whereas an electromagnet requires continuous power to create a magnetic field. In some aspects, using an electro-permanent magnet can be useful if the untethered downhole tool 500 is immobilized due to the magnetic pull force, and needs to free itself autonomously while downhole in the wellbore 20.

In example aspects, the untethered downhole tool 500 (as well as other untethered downhole tools according to the present disclosure) includes a microcontroller (that is or is part of or separate from the sensor package 999) with a time reference, electro-permanent magnet(s), and one or more sensors such as a pressure sensor, a temperature sensor, an accelerometer, or a magnetometer (or a combination thereof). The microcontroller in the tool 500 detects a motion of the tool 500 by recording and evaluating sensor outputs. In some aspects, the microcontroller includes one or more microprocessors and one or more memory modules connected to the one or more microprocessors.

For example, the microcontroller can calculate changes in pressure, temperature, acceleration, and/or magnetic field over time. As the untethered downhole tool 500 travels in the wellbore 20, pressure changes with the fluid column height and/or the interaction with the casing 35 produces an acceleration that is different than the gravitational acceleration, and the magnetic field varies due to the permanent magnetic field of the casing imparted during manufacturing process. If the change in one or more of these sensors over a time window stays below a threshold value (for example, less than 3 psi change in 1 minute, and/or less than 0.2° C. change in 1 minute, and/or less than 0.1 g change in acceleration in 1 minute, and/or less than 0.01 Gauss in 1 minute), the microcontroller can determine that the tool 500 is immobilized. The microcontroller reduces one or several electro-permanent magnet(s)'s magnetization to reduce the pull force towards the casing 35 until the immobilization conditions are not detected. As the microcontroller detects that the tool 500 is in motion, the microcontroller can decide to increase the magnetization of electro-permanent magnet (s) again to realign the tool 500 with the casing 35.

In some aspects, the magnet 510 (and other magnets as described herein) can serve dual purposes. First, the magnet 510 can orient or help orient the untethered downhole tool 500 as described herein, such as aligning the untethered downhole tool 500 with the casing 35. Second, the magnet 510 can create a magnetic field distribution. The magnetic field distribution is subject to change due to casing thickness or spacing between two casing joints. These changes can be detectable using magnetic sensors such coils, hall effect sensors, or giant magneto-resistive magnetometers within the sensor package 999. When an electro-permanent magnet is used, the added sensing element for the untethered downhole tool 500 as a casing collar locator (for example, a magnetometer) can also provide a feedback to a microprocessor about the polarization state of the magnet 510. This feedback can be used to time the magnetic field as necessary.

Further, in some aspects, the sensor package 999 can include an inertial sensor (for example, an accelerometer) that can be used to detect relatively rapid changes in diameter of the casing 35 (or other casing), which usually happens around a casing collar (such as casing collar 55). In example implementations as shown in FIGS. 5A-5B, as the untethered downhole tool 500 follows the casing wall of the casing 35, the tool's motion is disturbed at the joint locations (for example, at the casing collars), which can be detected as an acceleration in perpendicular direction to the motion. Thus, the inertial sensor of the sensor package 999 can be used as a casing collar locator.

Figure 7:
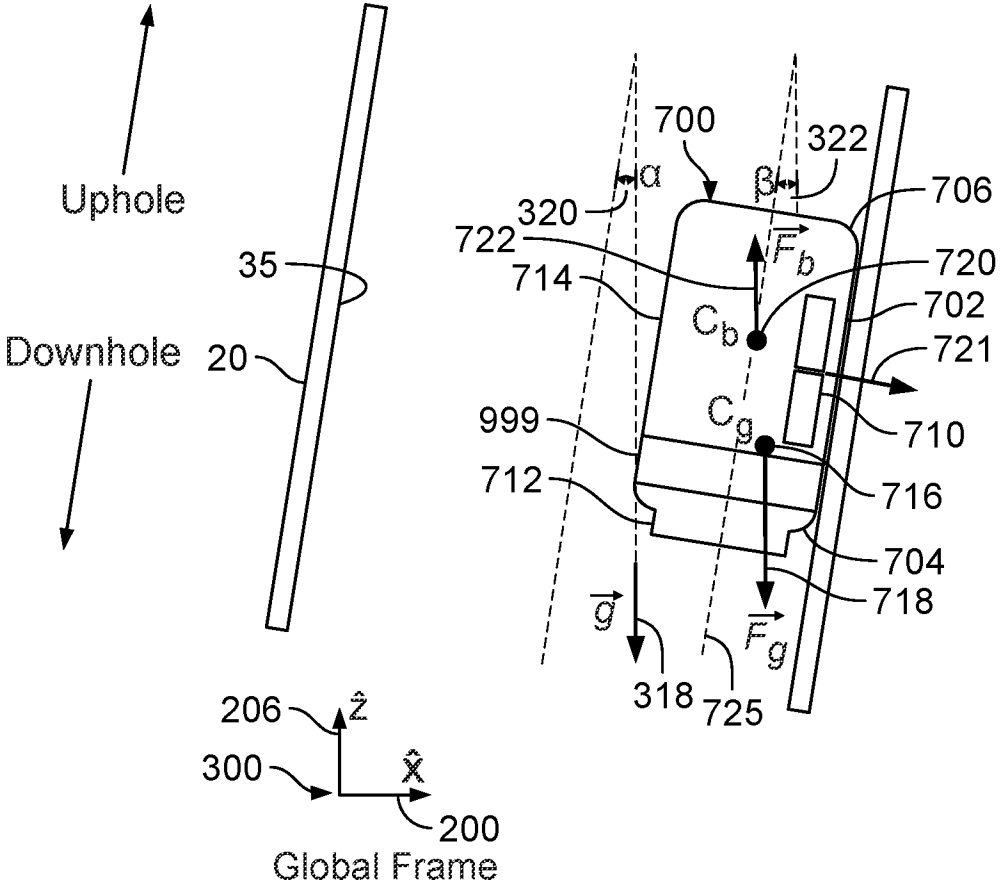
FIG. 7 is a schematic diagram of another example implementation of an untethered downhole tool that includes one or more mass components to adjust an orientation of the tool in three-dimensional space in a wellbore according to the present disclosure.

In the example implementation of FIGS. 5A-5B, a magnetic force 514 is generated by attraction of the magnet 510 with the casing 35 to generate a rotation 512 toward the casing 35. In some aspects, the magnetic force 514 may be combined with a righting moment (for example, as generated by a ballast and/or buoyant member as shown in FIG. 4). When magnetic force 514 is combined with a righting moment, the untethered downhole tool 500 can be fully aligned with the casing 35. For example, the righting moment can introduce an initial vertical alignment of the untethered downhole tool 500 as described with reference to FIG. 4. Also, the magnet 510 can urge the untethered downhole tool 500 towards the casing 35 with the magnetic force 514, thereby aligning a vertical axis 508 of the untethered downhole tool 500 with a deviation angle (for example, when $\alpha=\beta$) as illustrated in FIG. 7. In this case, the righting moment aligns the untethered downhole tool 500 with the gravitational axis while magnetic force 514 urges the untethered downhole tool 500 toward the casing 35. Therefore, in some aspects, alignment of the untethered downhole tool 500 depends on the positions of the center of gravity ($C_g$) of the untethered downhole tool 500 and the center of buoyancy ($C_b$) of the untethered downhole tool 500, as well as the magnitudes of a gravitational force ($F_g$), a buoyant force ($F_b$) and magnetic force 514 ($F_m$).

Figure 6A:
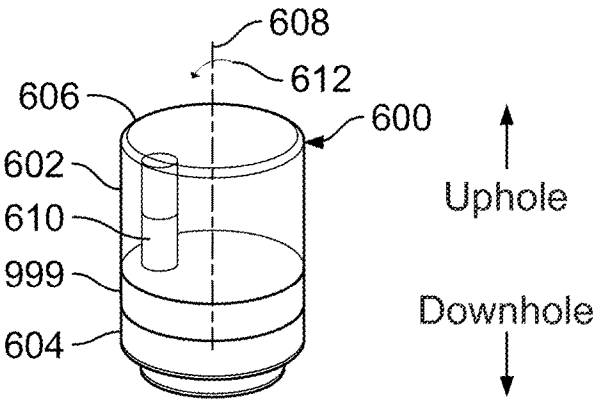
FIGS. 6A-6C are schematic diagrams of another example implementation of an untethered downhole tool that includes one or more mass components to adjust an orientation of the tool in three-dimensional space in a wellbore according to the present disclosure.
Figure 6B:
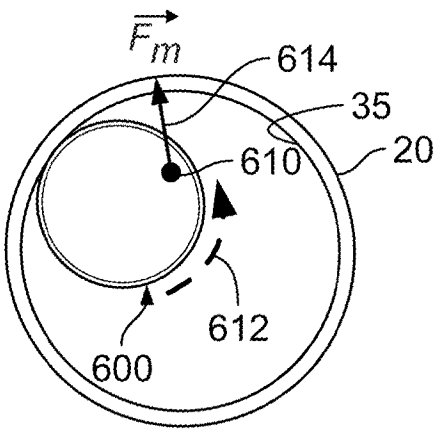
Figure 6C:
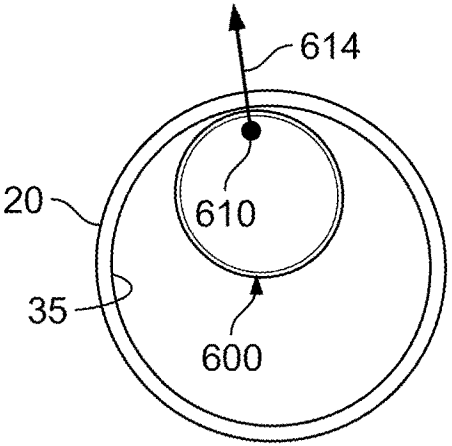

FIGS. 6A-6C are schematic diagrams of an example implementation of an untethered downhole tool 600 that includes one or more mass components to adjust an orientation of the tool in three-dimensional space in the wellbore 20. In some aspects, untethered downhole tool 600 can be used as or be the untethered downhole tool 100 shown in the wellbore system 10 shown in FIG. 1. FIGS. 6A-6C further show one or more forces acting on the untethered downhole tool 600. As shown in this example implementation, the untethered downhole tool 600 includes a housing 602 that has a downhole end 604 and an uphole end 606. The housing 602, in this example, includes a volume that can enclose all or a portion of the sensor package 999. The sensor package 999, as described, can include, for instance, a casing collar locator or other sensors configured to determine one or more measurements or characteristics of the casing 35, or other wellbore tubulars. The sensor package 999, in some aspects, may determine or measure one or more values associated with a fluid in the wellbore 20 or a subterranean formation adjacent the wellbore 20.

In this example, the one or more mass components include a magnet 610 positioned on or in the housing 502. In this example, the magnet 610 is positioned such that it is adjacent or near an interior surface of housing 602. In some aspects, the magnet 610 can be permanent, electro-permanent, or an electromagnet. Electro-permanent magnets can have benefits over the other two such that it can be turned off unlike a permanent magnet. An electro-permanent magnet can create a magnetic pull force with a smaller foot-print compared to an electromagnet and requires power only to change the magnetic polarization, whereas an electromagnet requires continuous power to create a magnetic field. In some aspects, using an electro-permanent magnet can be useful if the untethered downhole tool 600 is immobilized due to the magnetic pull force, and needs to free itself autonomously while downhole in the wellbore 20.

In some aspects, the magnet 610 (and other magnets as described herein) can serve dual purposes. First, the magnet 610 can orient or help orient the untethered downhole tool 600 as described herein, such as aligning the untethered downhole tool 600 with the casing 35. Second, the magnet 610 can create a magnetic field distribution. The magnetic field distribution is subject to change due to casing thickness or spacing between two casing joints. These changes can be detectable using magnetic sensors such coils, hall effect sensors, or giant magneto-resistive magnetometers within the sensor package 999. When an electro-permanent magnet is used, the added sensing element for the untethered downhole tool 600 as a casing collar locator (for example, a magnetometer) can also provide a feedback to a microprocessor about the polarization state of the magnet 610. This feedback can be used to time the magnetic field as necessary.

Further, in some aspects, the sensor package 999 can include an inertial sensor (for example, an accelerometer) that can be used to detect relatively rapid changes in diameter of the casing 35 (or other casing), which usually happens around a casing collar (such as casing collar 55). In example implementations as shown in FIGS. 6A-6C, as the untethered downhole tool 600 follows the casing wall of the casing 35, the tool's motion is disturbed at the joint locations (for example, at the casing collars), which can be detected as an acceleration in perpendicular direction to the motion. Thus, the inertial sensor of the sensor package 999 can be used as a casing collar locator.

In the example implementation of FIGS. 6A-6C, a magnetic force 614 is generated by attraction of the magnet 610 with the casing 35 to generate a rotation 612. The magnet 610 urges (rotates) the untethered downhole tool 600 against (or adjacent) the casing 35 with the magnetic force 614, thereby aligning a vertical axis 608 of the untethered downhole tool 600 in a parallel arrangement with a vertical axis of the wellbore 20. In some aspects, alignment of the untethered downhole tool 600 depends on the positions of the center of gravity ($C_g$) of the untethered downhole tool 600 and the center of buoyancy ($C_b$) of the untethered downhole tool 600, as well as the magnitudes of a gravitational force ($F_g$), a buoyant force ($F_b$) and magnetic force 614 ($F_m$).

FIG. 7 is a schematic diagram of another example implementation of an untethered downhole tool 700 that includes one or more mass components to adjust an orientation of the tool 700 in three-dimensional space in the wellbore 20. In some aspects, untethered downhole tool 700 can be used as or be the untethered downhole tool 100 shown in the wellbore system 10 shown in FIG. 1. FIG. 7 further shows one or more forces acting on the untethered downhole tool 700. As shown in this example implementation, the untethered downhole tool 700 includes a housing 702 that has a downhole end 704 and an uphole end 706. The housing 702, in this example, includes a volume that can enclose all or a portion of a sensor package 999. The sensor package 999 can include, for instance, a casing collar locator or other sensors configured to determine one or more measurements or characteristics of the casing 35, or other wellbore tubulars. The sensor package 999, in some aspects, may determine or measure one or more values associated with a fluid in the wellbore 20 or a subterranean formation adjacent the wellbore 20. In some aspects, as described with reference to FIGS. 5A-5B and 6A-6B, the sensor package 999 of the untethered downhole tool 700 can include an inertial sensor that acts as a casing collar locator.

In this example, the one or more mass components include a ballast 712 positioned on or in the housing 702 at or near the downhole end 704 and a buoyant member 714 positioned on or in the housing 702 at or near the uphole end 706. In some aspects, the ballast 712 may be a weight or member that is of a higher density or overall mass as compared to the buoyant member 714. In some aspects, the buoyant member 714 can be an empty or fluid-filled portion of the housing 702. In some aspects, the buoyant member 714 can have a lower density or weight relative to the ballast 712. In some aspects, the untethered downhole tool 700 may include only the ballast 712 or only the buoyant member 714, for example, depending on a desired orientation of the untethered downhole tool 700 within the wellbore 20.

In some aspects, one or both of the ballast 712 or buoyant member 714 can adjust (or help adjust) an orientation of the untethered downhole tool 700 in the wellbore, either alone or in combination. For example, the ballast 712 and/or buoyant member 714 may create a separation of a center of gravity ($C_g$) 716 (from which a gravitational force 718 originates) of the untethered downhole tool 700 and a center of buoyancy ($C_b$) 720 (from which a buoyant force 722 originates) of the untethered downhole tool 700. This separation can create a corrective (for example, righting) moment that rotates the housing 702 of the untethered downhole tool 700 to a stable position and minimizes its potential energy. For example, to create a separation between the two centers 716 and 720, a variation in density along an axis of the untethered downhole tool 700 is created by, for example, placement of the ballast 712 and/or the buoyant member 714. For instance, by grouping higher density components such as the sensor package 999 and the ballast 712 at the downhole end 704 and placing low density components such as the buoyant member 714 (for example, made of syntactic foam) at the uphole end 706, the righting moment can align yaw and pitch of the untethered downhole tool 700. In some aspects, this alignment occurs with respect to the direction of gravity 318 (in other words, angle $\beta$ is non-zero) and a degree of the alignment with the casing 35 may depend on the well deviation angle 320 ($\alpha$).

In this example, the one or more mass components also include a magnet 710 positioned on or in the housing 702. In this example, the magnet 710 is positioned such that it is adjacent or near an interior surface of housing 702. In some aspects, the magnet 710 can be permanent, electro-permanent, or an electromagnet. Electro-permanent magnets can have benefits over the other two such that it can be turned off unlike a permanent magnet. An electro-permanent magnet can create a magnetic pull force with a smaller foot-print compared to an electromagnet and requires power only to change the magnetic polarization, whereas an electromagnet requires continuous power to create a magnetic field. In some aspects, using an electro-permanent magnet can be useful if the untethered downhole tool 700 is immobilized due to the magnetic pull force, and needs to free itself autonomously while downhole in the wellbore 20.

In some aspects, the magnet 710 (and other magnets as described herein) can serve dual purposes. First, the magnet 710 can orient or help orient the untethered downhole tool 700 as described herein, such as aligning the untethered downhole tool 700 with the casing 35. Second, the magnet 710 can create a magnetic field distribution. The magnetic field distribution is subject to change due to casing thickness or spacing between two casing joints. These changes can be detectable using magnetic sensors such coils, hall effect sensors, or giant magneto-resistive magnetometers within the sensor package 999. When an electro-permanent magnet is used, the added sensing element for the untethered downhole tool 700 as a casing collar locator (for example, a magnetometer) can also provide a feedback to a microprocessor about the polarization state of the magnet 710. This feedback can be used to time the magnetic field as necessary.

In the example implementation of FIG. 7, a magnetic force 721 is generated by attraction of the magnet 710 with the casing 35 (that can, in some aspects, generate a rotation). The magnet 710 urges (rotates) the untethered downhole tool 700 against (or adjacent) the casing 35 with the magnetic force 721, thereby aligning a vertical axis 725 of the untethered downhole tool 700 in a parallel arrangement with a vertical axis of the wellbore 20. In some aspects, alignment of the untethered downhole tool 700 depends on the positions of the center of gravity 716 ($C_g$) of the untethered downhole tool 700 and the center of buoyancy 720 ($C_b$) of the untethered downhole tool 700, as well as the magnitudes of a gravitational force 718 ($F_g$), a buoyant force 722 ($F_b$) and magnetic force 721 ($F_m$).

FIGS. 8A-8B are schematic diagrams of another example implementation of an untethered downhole tool 800 that includes one or more mass components to adjust an orientation of the tool 800 in three-dimensional space in the wellbore 20. In some aspects, untethered downhole tool 800 can be used as or be the untethered downhole tool 100 shown in the wellbore system 10 shown in FIG. 1. FIGS. 8A-8B further show one or more forces acting on the untethered downhole tool 800. As shown in this example implementation, the untethered downhole tool 800 includes a housing 802 that has a downhole end 804 and an uphole end 806. The housing 802, in this example, includes a volume that can enclose all or a portion of a sensor package 999. The sensor package 999 can include, for instance, a casing collar locator or other sensors configured to determine one or more measurements or characteristics of the casing 35, or other wellbore tubulars. The sensor package 999, in some aspects, may determine or measure one or more values associated with a fluid in the wellbore 20 or a subterranean formation adjacent the wellbore 20. In some aspects, as described with reference to FIGS. 5A-5B and 6A-6B, the sensor package 999 of the untethered downhole tool 800 can include an inertial sensor that acts as a casing collar locator.

In this example, the one or more mass components include a ballast 808 positioned on or in the housing 802 at or near the downhole end 804 and a buoyant member 810 positioned on or in the housing 802 at or near the uphole end 806. In some aspects, the ballast 808 may be a weight or member that is of a higher density or overall mass as compared to the buoyant member 810. In some aspects, the buoyant member 810 can be an empty or fluid-filled portion of the housing 802. In some aspects, the buoyant member 810 can have a lower density or weight relative to the ballast 808. In some aspects, the untethered downhole tool 800 may include only the ballast 808 or only the buoyant member 810, for example, depending on a desired orientation of the untethered downhole tool 800 within the wellbore 20.

In some aspects, one or both of the ballast 808 or buoyant member 810 can adjust (or help adjust) an orientation of the untethered downhole tool 800 in the wellbore, either alone or in combination. For example, the ballast 808 and/or buoyant member 810 may create a separation of a center of gravity ($C_g$) 814 (from which a gravitational force 816 originates) of the untethered downhole tool 800 and a center of buoyancy ($C_b$) 822 (from which a buoyant force 820 originates) of the untethered downhole tool 800. This separation can create a corrective (for example, righting) moment that rotates the housing 802 of the untethered downhole tool 800 to a stable position and minimizes its potential energy. For example, to create a separation between the two centers 814 and 822, a variation in density along an axis of the untethered downhole tool 800 is created by, for example, placement of the ballast 808 and/or the buoyant member 810. For instance, by grouping higher density components such as the sensor package 999 and the ballast 808 at the downhole end 804 and placing low density components such as the buoyant member 810 (for example, made of syntactic foam) at the uphole end 806, the righting moment can align yaw and pitch of the untethered downhole tool 800. In some aspects, this alignment occurs with respect to the direction of gravity (in other words, angle β is non-zero) and a degree of the alignment with the casing 35 may depend on the well deviation angle.

In this example, the one or more mass components also include one or more fins 812*a* and 812*b* mounted to an exterior surface of the housing 802. For example, as described herein, righting moments and magnetic forces are (generally) static forces that may not depend on a travel speed 337 of the untethered downhole tool 800. However, hydrodynamic shape of the untethered downhole tool 800 (or any untethered downhole tool according to the present disclosure) becomes more influential as the tool's relative velocity with respect to a fluid in the wellbore 20 increases. For instance, a hydrodynamic design can urge an untethered downhole tool towards a side of the casing 35 and keep the tool against the casing 35 during motion. In some aspects, fins 812*a* and 814*a* mounted on opposed radial sides (for example, 180° apart on the exterior surface of the housing 802) may act to generate one or both of a vertical hydrodynamic force 818 or a radial hydrodynamic force 824 (for example, in combination with a fluid in the wellbore 20) to urge the untethered downhole tool 800 towards a side of the casing 35 and keep the tool 800 against the casing 35 during motion. As shown, each fin 812*a* and 812*b* is angled relative to an axial axis of the untethered downhole tool 800.

Figure 9B:
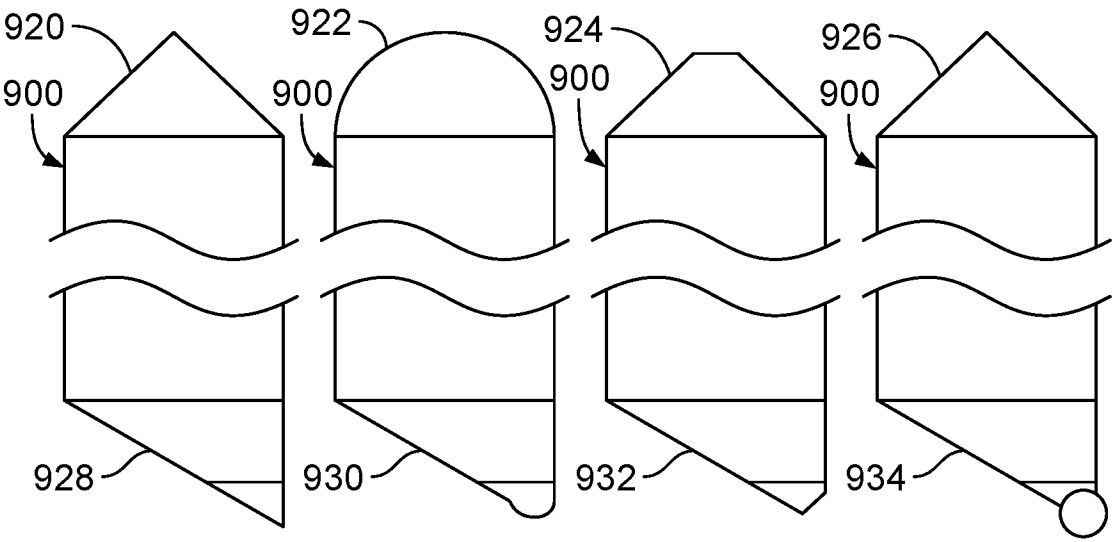
FIGS. 9A-9C are schematic diagrams of other example implementations of an untethered downhole tool that includes one or more mass components to adjust an orientation of the tool in three-dimensional space in a wellbore according to the present disclosure.
Figure 9A:
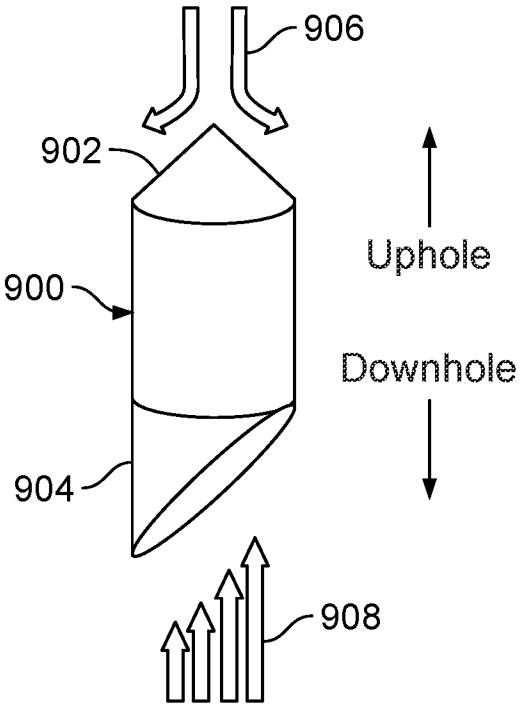
Figure 9C:
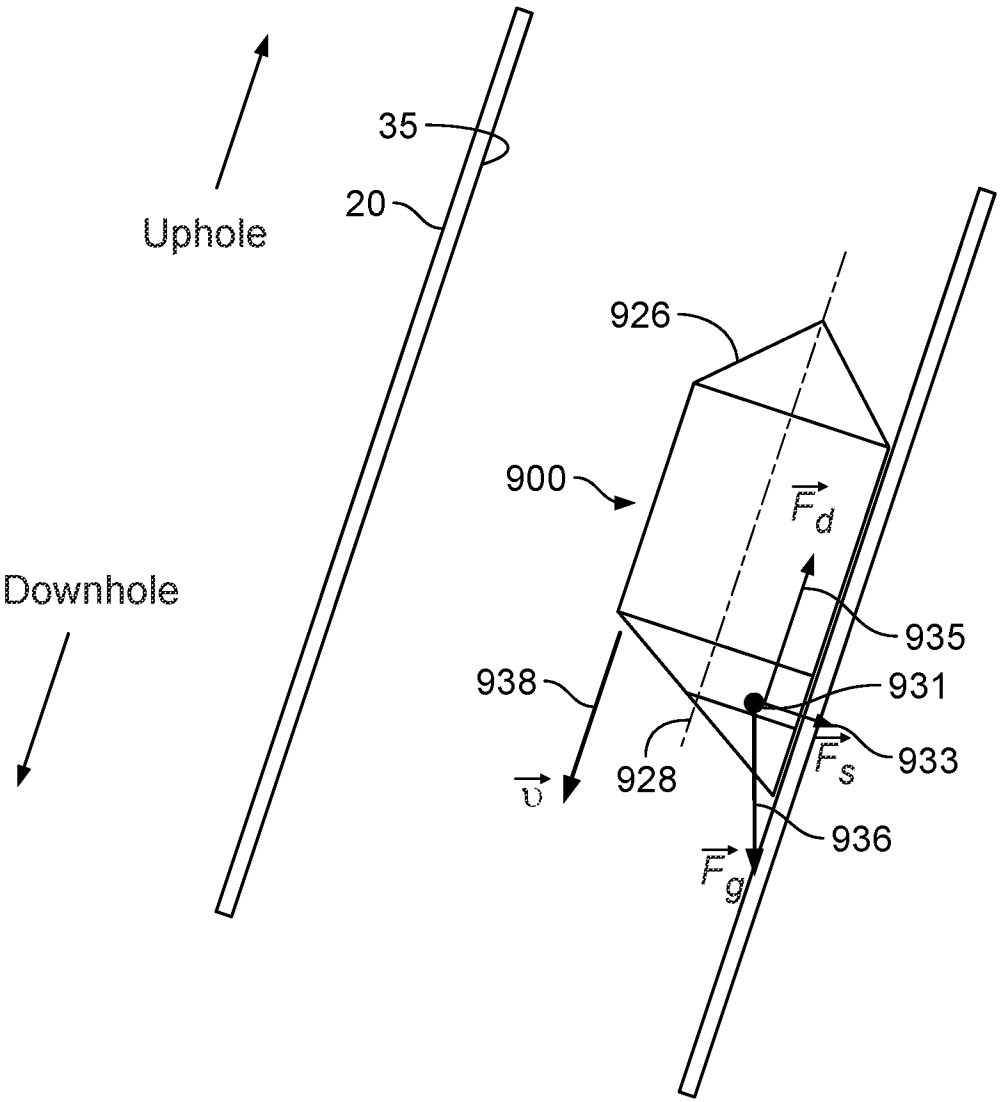

FIGS. 9A-9C are schematic diagrams of other example implementations of an untethered downhole tool 900 that includes one or more mass components to adjust an orientation of the tool in three-dimensional space in a wellbore. In this example, untethered downhole tool 900 includes a cap 902 positioned at or mounted to an uphole end of the untethered downhole tool 900 and a nose 904 positioned at or mounted to a downhole end of the untethered downhole tool 900. As shown in FIG. 9A, one or both of the cap 902 and nose 904 may adjust an orientation of the untethered downhole tool 900 when subject to one or both of a gravitational force 906 or a drag force 908 (for example, when running into a wellbore).

For example, hydrodynamic forces can be used to constrain ρ, β, and γ which are necessary to align the untethered downhole tool 900 with respect to a casing in a wellbore. Since hydrodynamics forces may act on the untethered downhole tool 900 during motion of the untethered downhole tool 900, such forces can be combined with, for example, a righting moment and/or a magnetic force (as previously described) to have a more stable orientation that is not disturbed by the magnitude of the velocity of the untethered downhole tool 900 in a downhole direction. Thus, in some aspects, the untethered downhole tool 900 may include, for example, one or more of a ballast, a buoyant member, one or more magnets, or one or more fins as previously described.

In some aspects, as shown in FIG. 9C, hydrodynamic forces acting on a negatively buoyant free falling object in a static fluid column, such as the untethered downhole tool 900 in a wellbore, depends on fluid properties and effective contact surface area of the exterior surface of the untethered downhole tool 900 with the fluid. In some aspects, one or both of the cap 902 or nose 904 may (by their shape) be optimized to provide a desired horizontal force 933 ($F_S$) as the tool 900 moves with velocity 938 (v) in order to decenter the untethered downhole tool 900 while minimizing the drag force 935 ($F_d$), each of which originate at a center of gravity 931 of the tool 900.

FIG. 9B shows example implementations of a nose and a cap for the untethered downhole tool 900. Example caps include a sharp cap 920 (for example, in the shape of a pyramid), a rounded cap 922 (for example, in the same of a hemisphere or partial sphere), a flat cap 924 (for example, in a frustoconical shape), or a conic cap 926 (for example, in the shape of a cone). Example shapes of a nose include a sharp nose 928 (for example, with a sharp point aligned with a side of the untethered downhole tool 900), a rounded nose 930 (for example, with a rounded point aligned with a side of the untethered downhole tool 900), a conic nose 932 (for example, with a flattened or angled portion), or a wheeled nose 934 (for example, with a wheel or roller positioned in alignment with a side of the untethered downhole tool 900). Each of the example nose shapes can be combined with any of the example cap shapes in various example implementations.

FIGS. 10A-10F are schematic diagrams of other example implementations of an untethered downhole tool (1000, 1020, and 1040) that includes one or more mass components to adjust an orientation of the tool in three-dimensional space in a wellbore. Untethered downhole tools 1000, 1020, or 1040 can be used as or be the untethered downhole tool 100 shown in the wellbore system 10 shown in FIG. 1. Turning to FIGS. 10A and 10B, these figures show an example implementation of a untethered downhole tool 1000. In this example, the untethered downhole tool 1000 includes a housing 1002 that has a downhole end 1004 and an uphole end 1006. The housing 1002, in this example, includes a volume that can enclose all or a portion of a sensor package 999. The sensor package 999 can include, for instance, a casing collar locator or other sensors configured to determine one or more measurements or characteristics of the casing 35, or other wellbore tubulars. The sensor package 999, in some aspects, may determine or measure one or more values associated with a fluid in the wellbore 20 or a subterranean formation adjacent the wellbore 20. In some aspects, as described with reference to FIGS. 5A-5B and 6A-6B, the sensor package 999 of the untethered downhole tools 1000, 1020, and 1040 can include an inertial sensor that acts as a casing collar locator.

In this example, the one or more mass components include a ballast 1005 positioned on or in the housing 1002 at or near the downhole end 1004 and a buoyant member 1010 positioned on or in the housing 1002 at or near the uphole end 1006. In some aspects, the ballast 1005 may be a weight or member that is of a higher density or overall mass as compared to the buoyant member 1010. In some aspects, the buoyant member 1010 can be an empty or fluid-filled portion of the housing 1002. In some aspects, the buoyant member 1010 can have a lower density or weight relative to the ballast 1005. In some aspects, the untethered downhole tool 1000 may include only the ballast 1005 or only the buoyant member 1010, for example, depending on a desired orientation of the untethered downhole tool 1000 within a wellbore.

In some aspects, one or both of the ballast 1005 or buoyant member 1010 can adjust (or help adjust) an orientation of the untethered downhole tool 1000 in the wellbore, either alone or in combination as described herein. Further, in this example, the one or more mass components also include a magnet 1012 positioned on or in the housing 1002. In this example, the magnet 1012 is positioned such that it is aligned with an axial centerline of the untethered downhole tool 1000. In some aspects, the magnet 1012 can be similar to, for example, the magnet 710 as shown and described in FIG. 7.

As shown in this example, the one or more mass components also include one or more wheels or rollers 1014 attached or coupled to the housing 1002. In some aspects, the wheels 1014 (four shown here, radially spaced 90° apart around the housing 1002) can reduce a surface area of the untethered downhole tool 1000 in contact with the casing 35 and keep a certain distance between the housing 1002 and the casing 35. In some aspects, a smaller contact area can reduce the magnitude of adhesion force between the untethered downhole tool 1000 and the casing 35. In some aspects, the wheels 1014 can also reduce an energy loss due to friction (for example, if there is no slip). In the presence of the magnet 1012, parameter such as wheel size, magnet position inside the tool 1000, and magnet strength can be optimized to tune a side pulling force ($F_m$). In some aspects, the wheels 1014 include suspensions that can smooth the motion if there are irregularities on the casing surface such as scale build-ups or joint gaps.

Turning to FIGS. 10C and 10D, these figures show an example implementation of a untethered downhole tool 1020. In this example, the untethered downhole tool 1020 includes a housing 1022 that has a downhole end 1024 and an uphole end 1026. The housing 1022, in this example, includes a volume that can enclose all or a portion of a sensor package 999. The sensor package 999 can include, for instance, a casing collar locator or other sensors configured to determine one or more measurements or characteristics of the casing 35, or other wellbore tubulars. The sensor package 999, in some aspects, may determine or measure one or more values associated with a fluid in the wellbore 20 or a subterranean formation adjacent the wellbore 20.

In this example, the one or more mass components include a ballast 1025 positioned on or in the housing 1022 at or near the downhole end 1024 and a buoyant member 1030 positioned on or in the housing 1022 at or near the uphole end 1026. In some aspects, the ballast 1025 may be a weight or member that is of a higher density or overall mass as compared to the buoyant member 1030. In some aspects, the buoyant member 1030 can be an empty or fluid-filled portion of the housing 1022. In some aspects, the buoyant member 1030 can have a lower density or weight relative to the ballast 1025. In some aspects, the untethered downhole tool 1020 may include only the ballast 1025 or only the buoyant member 1030, for example, depending on a desired orientation of the untethered downhole tool 1020 within a wellbore.

In some aspects, one or both of the ballast 1025 or buoyant member 1030 can adjust (or help adjust) an orientation of the untethered downhole tool 1020 in the wellbore, either alone or in combination as described herein. Further, in this example, the one or more mass components also include a magnet 1032 positioned on or in the housing 1022. In this example, the magnet 1032 is positioned such that it is adjacent an interior surface of the housing 1022 of the untethered downhole tool 1020. In some aspects, the magnet 1032 can be similar to, for example, the magnet 710 as shown and described in FIG. 7.

As shown in this example, the one or more mass components also include one or more wheels or rollers 1034 attached or coupled to the housing 1022. In some aspects, the wheels 1034 (two shown here, radially spaced 90° apart from each other around the housing 1022) can reduce a surface area of the untethered downhole tool 1020 in contact with the casing 35 and keep a certain distance between the housing 1022 and the casing 35. As compared to untethered downhole tool 1000, the magnet 1032 that is misaligned with a centerline axis of the tool 1020 can create a preferred rotational alignment direction with respect to the casing 35. Therefore, the wheels 1034 are placed on a same radial side of the housing 1022 with the magnet 1032 where attachment to the casing 35 will most likely occur to maximize contact between the wheels 1034 and the casing 35 (and minimize a surface area contact between the untethered downhole tool 1020 and the casing 35).

Turning to FIGS. 10E and 10F, these figures show an example implementation of a untethered downhole tool 1040. In this example, the untethered downhole tool 1040 includes a housing 1042 that has a downhole end 1044 and an uphole end 1046. The housing 1042, in this example, includes a volume that can enclose all or a portion of a sensor package 999. The sensor package 999 can include, for instance, a casing collar locator or other sensors configured to determine one or more measurements or characteristics of the casing 35, or other wellbore tubulars. The sensor package 999, in some aspects, may determine or measure one or more values associated with a fluid in the wellbore 20 or a subterranean formation adjacent the wellbore 20.

In this example, the one or more mass components include a ballast 1045 positioned on or in the housing 1042 at or near the downhole end 1044 and a buoyant member 1050 positioned on or in the housing 1042 at or near the uphole end 1046. In some aspects, the ballast 1045 may be a weight or member that is of a higher density or overall mass as compared to the buoyant member 1050. In some aspects, the buoyant member 1050 can be an empty or fluid-filled portion of the housing 1042. In some aspects, the buoyant member 1050 can have a lower density or weight relative to the ballast 1045. In some aspects, the untethered downhole tool 1040 may include only the ballast 1045 or only the buoyant member 1050, for example, depending on a desired orientation of the untethered downhole tool 1040 within a wellbore.

In some aspects, one or both of the ballast 1045 or buoyant member 1050 can adjust (or help adjust) an orientation of the untethered downhole tool 1040 in the wellbore, either alone or in combination as described herein. Further, in this example, the one or more mass components also include a magnet 1052 positioned on or in the housing 1042. In this example, the magnet 1052 is positioned such that it is adjacent an interior surface of the housing 1042 of the untethered downhole tool 1040. In some aspects, the magnet 1052 can be similar to, for example, the magnet 710 as shown and described in FIG. 7.

As shown in this example, the one or more mass components also include one or more wheels or rollers 1054 attached or coupled to the housing 1042. In some aspects, the wheels 1054 (four shown here, with pairs radially spaced 180° apart around the housing 1042 and one of each pair positioned near the uphole end 1046 and one positioned near the downhole end 1044) can reduce a surface area of the untethered downhole tool 1040 in contact with the casing 35 and keep a certain distance between the housing 1042 and the casing 35. In this example, the wheels 1054 may be large enough to contact the casing 35 at two locations each and can generate larger torque (relative to wheels 1014 and 1034), which can provide for easier rotation in a presence of adhesive forces or relatively large surface irregularities of the casing 35.

A number of implementations have been described. Nevertheless, it will be understood that various modifications may be made without departing from the spirit and scope of the disclosure. For example, example operations, methods, or processes described herein may include more steps or fewer steps than those described. As another example, in some aspects, sleds may be substituted for wheels in an untethered downhole tool that includes wheels, as sleds can provide similar benefits with wheels, such as reducing the contact area and spacing the tool body from the casing but can also provide a smaller footprint as compared to wheels and have no moving parts as compared to wheels. As another example, an untethered downhole tool according to the present disclosure may include a low friction material added to or as part of a housing, such as Teflon™ or other material. Further, the steps in such example operations, methods, or processes may be performed in different successions than that described or illustrated in the figures. Accordingly, other implementations are within the scope of the following claims.

What is claimed is:

1. A downhole tool, comprising:

a body configured to move in a wellbore formed from a terranean surface to a subterranean formation in a direction downhole of the terranean surface independent of a downhole conveyance attached to the body;

one or more sensors, positioned in or on the body, the one or more sensors configured to measure a value associated with at least one of the wellbore or the terranean surface; and at least one orientation component positioned in, or attached to, the body and configured to adjust an orientation of the body in response to one or more forces acting on the body as the downhole tool moves in the wellbore in the direction downhole of the terranean surface, the at least one orientation component comprising:

a first of the at least one orientation component comprising a buoyant portion positioned within, or attached to, a first location of the body at or near an uphole end of the body and configured to generate a buoyant force of the one or more forces acting on the body in an uphole direction;

a second of the at least one orientation component comprising a ballast portion positioned within, or attached to, a second location of the body at or near a downhole end of the body;

a third of the at least one orientation component comprising at least one magnet positioned within, or attached to, a third location of the body; and a microcontroller that:

detects an immobilization of the downhole tool based on outputs of the one or more sensors, and reduces, in response to the detection of the immobilization, a magnetization of the at least one magnet to reduce a pull force towards a casing.

2. The downhole tool of claim 1, wherein the buoyant portion comprises a first buoyant portion attached to an exterior surface of the body at a first exterior location and a second buoyant portion attached to the exterior surface of the body at a second exterior location radially opposite the first exterior location.

3. The downhole tool of claim 1, wherein the at least one magnet is positioned within the body to align, with a magnetization force, the body with the casing, the at least one magnet configured to generate a magnetic field distribution that is detectable by a casing collar locator that comprises one or more magnetic sensors.

4. The downhole tool of claim 3, wherein the at least one magnet comprises an electro-permanent magnet.

5. The downhole tool of claim 4, wherein the electro-permanent magnet is configured to generate a magnetic field distribution that is detectable by a casing collar detector that comprises one or more magnetic sensors.

6. The downhole tool of claim 1, wherein the body comprises a cap portion located at an uphole end of the body and a nose portion located at a downhole end of the body.

7. The downhole tool of claim 6, wherein the cap portion comprises a sharp cap, a rounded cap, a flat cap, or a conic cap.

8. The downhole tool of claim 6, wherein the nose portion comprises a sharp nose, a rounded nose, or a conic nose.

9. The downhole tool of claim 8, wherein the nose portion further comprises at least one wheel or roller mounted to a downhole end of the nose portion.

10. The downhill tool of claim 1, further comprising one or more wheels coupled to an exterior surface of the body.

11. The downhole tool of claim 1, wherein the one or more forces comprises the buoyant force and a gravitational force.

12. The downhole tool of claim 1, wherein the one or more sensors comprises at least one of a casing collar detector or a corrosion detector.

13. The downhole tool of claim 1, wherein the at least one magnet comprises an electro-permanent magnet.

14. The downhole tool of claim 13, wherein the electro-permanent magnet is configured to generate a magnetic field distribution that is detectable by a casing collar detector that comprises one or more magnetic sensors.

15. The downhole tool of claim 1, wherein the buoyant portion comprises a void in the body.

16. The downhole tool of claim 15, wherein the void is filled with fluid.

17. The downhole tool of claim 1, wherein the value comprises a pressure or a temperature.

18. The downhole tool of claim 1, wherein the microcontroller further:

detects a cessation of the immobilization, and increases, in response to the detection of the cessation of the immobilization, a magnetization of the at least one magnet to align the downhole tool with the casing.

19. A method for running an untethered downhole tool in a wellbore, comprising:

inserting the untethered downhole tool into the wellbore at a terranean surface, the untethered downhole tool comprising a body, one or more sensors positioned in the body, and at least one orientation component positioned in, or attached to, the body;

running the untethered downhole tool within the wellbore in a direction downhole of the terranean surface and toward a subterranean formation independent of a downhole conveyance attached to the body;

adjusting, with the at least one orientation component positioned in, or attached to, the body, an orientation of the body in response to one or more forces acting on the body as the downhole tool runs in the wellbore in the direction downhole of the terranean surface, the adjusting comprising:

adjusting the orientation of the body relative to the one or more forces acting on the body with a first of the at least one orientation component comprising a buoyant portion that generates a buoyant force of the one or more forces acting on the body in an uphole direction, the buoyant portion positioned within, or attached to, a first location of the body at or near an uphole end of the body;

adjusting the orientation of the body relative to the one or more forces acting on the body with a second of the at least one orientation component comprising a ballast portion that is positioned within, or attached to, a second location of the body at or near a downhole end of the body;

adjusting the orientation of the body relative to the one or more forces acting on the body with a third of the at least one orientation component comprising at least one magnet that is positioned within, or attached to, a third location of the body; and adjusting the orientation of the body relative to the one or more forces acting on the body with a microcontroller, wherein adjusting the orientation of the body with the microcontroller comprises:

detecting an immobilization of the downhole tool based on outputs of the one or more sensors, and reducing, in response to the detection of the immobilization, a magnetization of the at least one magnet to reduce a pull force towards a casing.

20. The method of claim 19, wherein the buoyant portion comprises a first buoyant portion and a second buoyant portion, wherein adjusting the orientation of the body relative to the one or more forces acting on the body with the buoyant portion of the at least one orientation component that is positioned within, or attached to, a first location of the body comprises:

adjusting the orientation of the body relative to the one or more forces acting on the body with the first buoyant portion attached to an exterior surface of the body at a first exterior location; and adjusting the orientation of the body relative to the one or more forces acting on the body with the second buoyant portion attached to the exterior surface of the body at a second exterior location radially opposite the first exterior location.

21. The method of claim 20, wherein adjusting, with the at least one orientation component positioned in the body, the orientation of the body relative to the one or more forces acting on the body comprises:

adjusting, with at least one magnet positioned within, or attached to, a third location of the body, the orientation of the body relative to the one or more forces acting on the body by generating a magnetic force with the at least one magnet relative to a casing positioned in the wellbore.

22. The method of claim 19, wherein adjusting the orientation of the body relative to the one or more forces acting on the body with the at least one magnet comprises:

adjusting, with the at least one magnet positioned within, or attached to, a location of the body, the orientation of the body relative to the one or more forces acting on the body by generating a magnetic force with the at least one magnet relative to a casing positioned in the wellbore.

23. The method of claim 22, wherein the at least one magnet comprises at least one electro-permanent magnet, the method further comprising:

adjusting the generated magnetic force by changing a magnetization of the at least one electro-permanent magnet; and based on the adjusted magnetic force, changing a position of the body relative to the casing.

24. The method of claim 22, wherein the at least one magnet comprises at least one electro-permanent magnet, the method further comprising:

detecting one or more casing collars with the at least one electro-permanent magnet during the running of the untethered downhole tool within the wellbore.

25. The method of claim 19, further comprising adjusting one or more hydrodynamic forces that acts on the body as the untethered downhole tool runs in the wellbore in the direction downhole of the terranean surface with at least one of a cap portion located at an uphole end of the body or a nose portion located at a downhole end of the body.

26. The method of claim 25, wherein the cap portion comprises a sharp cap, a rounded cap, a flat cap, or a conic cap.

27. The method of claim 25, wherein the nose portion comprises a sharp nose, a rounded nose, or a conic nose.

28. The method of claim 27, further comprising contacting, with at least one wheel or roller mounted to a downhole end of the nose portion, the wellbore or a casing installed in the wellbore as the untethered downhole tool runs in the wellbore in the direction downhole of the terranean surface.

29. The method of claim 19, further comprising contacting, with one or more wheels coupled to an exterior surface of the body, the wellbore or a casing installed in the wellbore as the downhole tool runs in the wellbore in the direction downhole of the terranean surface.

30. The method of claim 19, wherein the one or more forces comprises the buoyant force and a gravitational force.

31. The method of claim 19, further comprising measuring a value associated with at least one of the wellbore or the terranean surface with the one or more sensors as the untethered downhole tool runs in the wellbore in the direction downhole of the terranean surface.

32. A downhole tool system, comprising:

an untethered downhole tool that comprises a housing and a sensor package, mounted in the housing, the housing comprising a downhole end and an uphole end; and means for orienting the untethered downhole tool with respect to a radial alignment angle and one or more vertical alignment angles in response to one or more forces acting on the untethered downhole tool as the untethered downhole tool runs in a wellbore in a direction downhole of a terranean surface, the means for orienting the untethered downhole tool mounted within or attached to the housing, the means for orienting the untethered downhole tool comprising:

a first mass having a first density positioned at or near the downhole end and configured to generate a gravitational force on the housing in a downhole direction, a second mass having a second density less than the first density positioned at or near the uphole end and configured to generate a buoyant force on the housing in an uphole direction, at least one magnet positioned within, or attached to, a third location of the body; and a microcontroller that:

detects an immobilization of the downhole tool based on outputs of the one or more sensors, and reduces, in response to the detection of the immobilization, a magnetization of the at least one magnet to reduce a pull force towards a casing.

33. The downhole tool system of claim 32, wherein the means for orienting the untethered downhole tool further comprises one or more magnets positioned in or attached to the housing.

34. The downhole tool system of claim 32, wherein the second mass comprises an uphole cap mounted on the uphole end.

35. The downhole tool system of claim 32, wherein the first mass comprises a downhole cap mounted on the downhole end.

36. The downhole tool system of claim 32, wherein the means for orienting the untethered downhole tool further comprises one or more wheels mounted to the housing.

37. The downhole tool system of claim 32, wherein the sensor package comprises an inertial sensor that comprises a casing collar locator.

* * * * *